US007242138B2

(12) United States Patent
Bunk et al.

(10) Patent No.: US 7,242,138 B2
(45) Date of Patent: Jul. 10, 2007

(54) ELECTRIC LIGHT BULB

(75) Inventors: Axel Bunk, München (DE); Andreas Nittke, Bergheim (DE)

(73) Assignee: Patent-Treuhand-Gesellschaft für Elektrische Gluhlampen mbH, Munich (DE)

( * ) Notice: Subject to any disclaimer, the term of this patent is extended or adjusted under 35 U.S.C. 154(b) by 226 days.

(21) Appl. No.: 10/521,403

(22) PCT Filed: Jul. 4, 2003

(86) PCT No.: PCT/DE03/02248

§ 371 (c)(1),
(2), (4) Date: Jan. 18, 2005

(87) PCT Pub. No.: WO2004/019371

PCT Pub. Date: Mar. 4, 2004

(65) Prior Publication Data

US 2005/0242733 A1 Nov. 3, 2005

(30) Foreign Application Priority Data

Aug. 8, 2002 (DE) ..... 102 36 549

(51) Int. Cl.
*H01J 17/16* (2006.01)

(52) U.S. Cl. ..... 313/489; 313/110; 313/112

(58) Field of Classification Search ..... 313/489, 313/518, 110, 112, 578, 580
See application file for complete search history.

(56) References Cited

U.S. PATENT DOCUMENTS

| | | | | |
|---|---|---|---|---|
| 3,188,513 | A * | 6/1965 | Hansler | 313/112 |
| 3,219,868 | A * | 11/1965 | Mason et al. | 313/571 |
| 4,017,758 | A * | 4/1977 | Almer et al. | 313/112 |
| 4,517,491 | A | 5/1985 | Otto et al. | |
| 5,146,134 | A | 9/1992 | Stadler et al. | |
| 5,670,840 | A * | 9/1997 | Lanese et al. | 313/25 |
| 5,811,934 | A | 9/1998 | Bunk et al. | |
| 6,225,731 | B1 | 5/2001 | Auyang | |

FOREIGN PATENT DOCUMENTS

EP 0 446 460 A2 9/1991

* cited by examiner

*Primary Examiner*—Vip Patel
(74) *Attorney, Agent, or Firm*—Frishauf, Holtz, Goodman & Chick, P.C.

(57) ABSTRACT

An electric light bulb, in particular a halogen light bulb designed to be operated by mains voltage includes a substantially axially symmetrical bulb and a single-coil filament mounted in the bulb. The filament includes at least one incandescent coil section disposed outside the bulb axis. The incandescent coil is disposed axially in a transparent cylindrical sleeve which has an interference filter that reflects infra-red rays.

10 Claims, 4 Drawing Sheets

ELECTRIC LIGHT BULB

Figure 1:
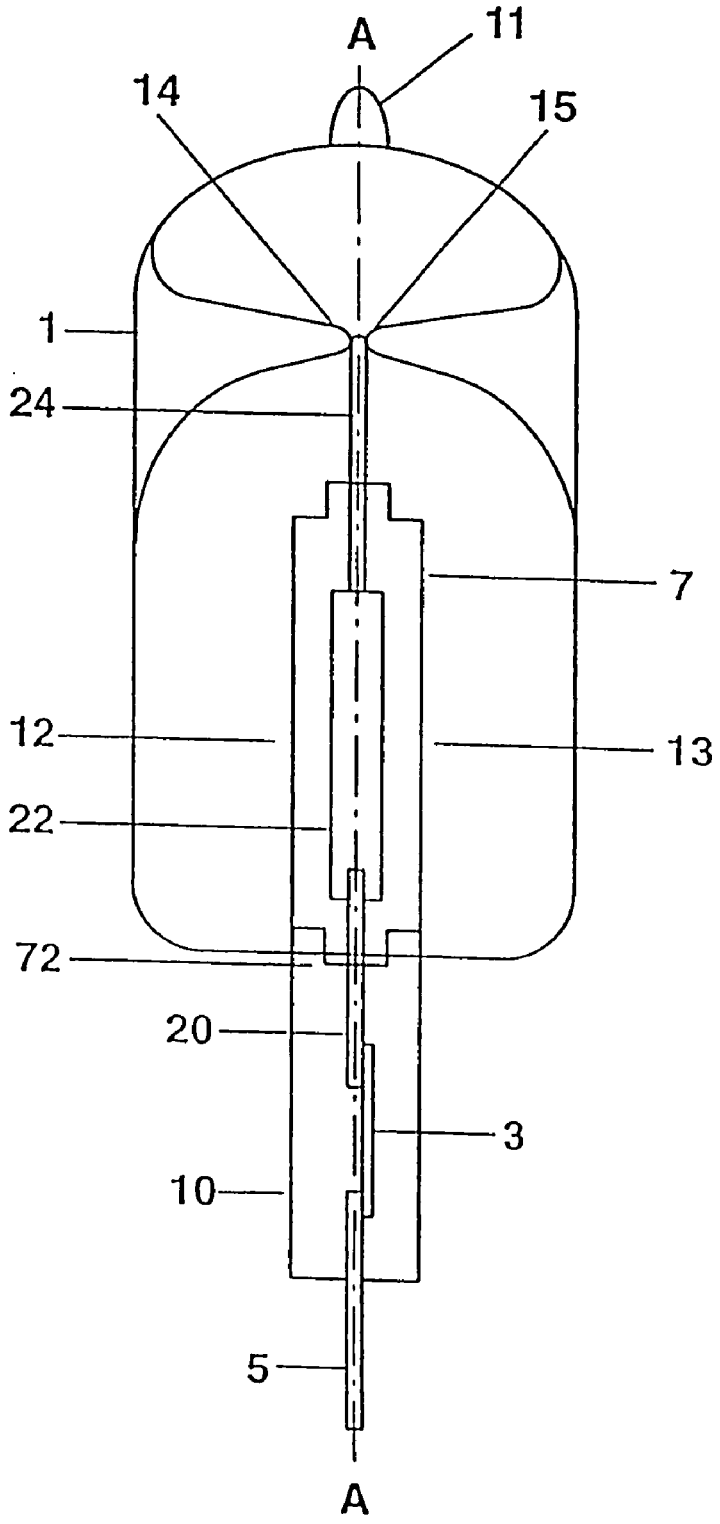

This application is a U.S. National Phase Application under 35 USC 371 of International Application PCT/DE03/02248 filed Jul. 4, 2003.

The invention relates to an electric incandescent lamp in accordance with the preamble of patent claim 1.

I. PRIOR ART

The patent application having the publication number WO 95/34910 and filed in accordance with the international patent convention describes a halogen incandescent lamp, in particular a low-voltage halogen incandescent lamp, having a rotationally symmetrical lamp vessel and an incandescent filament arranged axially therein. In order to raise the efficiency of the halogen incandescent lamp, the lamp vessel bears an interference filter that retroreflects onto the incandescent filament the infrared radiation emitted by the incandescent filament.

U.S. Pat. No. 6,225,731 discloses a halogen incandescent lamp having an axially symmetrical lamp vessel in which an incandescent filament is axially arranged. The incandescent filament is surrounded by a transparent and ellipsoidal sleeve that is arranged inside the lamp vessel, bears an interference filter that reflects infrared rays, and is open at both ends.

In the case of high-voltage halogen incandescent lamps that are operated directly on AC supply voltage, the luminous filament sections of the incandescent filament are frequently arranged outside the axis of symmetry of the lamp vessel because of their relatively large dimensions. European laid-open specification EP 0 446 460 A2 describes, for example, a high-voltage halogen incandescent lamp having an incandescent filament in the form of a V or U that has a number of luminous filament sections arranged outside the lamp vessel axis. It is not possible in the case of such a high-voltage halogen incandescent lamp to achieve any significant increase in light yield with the aid of an interference filter in accordance with WO 95/34910 that is fitted on the lamp vessel, or with the aid of an ellipsoidal sleeve in accordance with U.S. Pat. No. 6,225,731.

II. SUMMARY OF THE INVENTION

It is the object of the invention to improve the light yield in the case of an electric incandescent lamp, in particular in the case of a high-voltage halogen incandescent lamp whose incandescent filament has filament sections arranged outside the axis of symmetry of the lamp vessel.

This object is achieved according to the invention by means of the features of patent claim 1. Particularly advantageous designs of the invention are described in the dependent patent claims.

The electric incandescent lamp according to the invention has a substantially axially symmetrical lamp vessel, at least one incandescent filament that is arranged therein and has at least one filament section arranged outside the lamp vessel axis, and supply leads for the at least one incandescent filament. According to the invention, the at least one filament section is arranged axially in a transparent cylindrical sleeve that is provided with an interference filter which reflects infrared rays.

The interference filter fitted on the transparent cylindrical sleeve is used to retroreflect the infrared radiation emitted by the enclosed filament section onto the latter and to heat it up. In accordance with this heating up caused by the infrared radiation, the electric energy for the incandescent filament can be reduced, and the light yield can thereby be raised. The invention thereby enables the light yield to be raised independently of the shape of the lamp vessel, and independently of the alignment of the incandescent filament inside the lamp vessel.

The transparent cylindrical sleeve is advantageously in the form of a circularly cylindrical tube for reasons of production engineering. Before being mounted, this tube can be provided with the interference filter and be threaded onto the at least one luminous filament section, for example after the fusing of the supply leads with the incandescent filament. The circularly cylindrical shape of the sleeve further promotes the focusing of the infrared radiation reflected by the interference filter onto the filament section arranged on the cylinder axis. Given the use of a circularly cylindrical tube, the interference filter can advantageously be applied as a coating to the outer or inner lateral surface of the tube. Because it is near to the incandescent filament, the sleeve is exposed to very high temperatures and therefore preferably consists of hard glass or of silica glass.

It is best to fix the sleeve on the lamp vessel or on the incandescent filament. Fixing the sleeve on the lamp vessel can be implemented with particular advantage by means of a fuse connection with the lamp vessel. For this purpose, one end of the sleeve is preferably sealed in a sealed end of the lamp vessel, or inwardly directed knobs in the wall of the lamp vessel are fused with the sleeve. Fixing the sleeve on the incandescent filament can be implemented with particular advantage by means of a pinch of the sleeve that is arranged over a non-luminous section of the incandescent filament and connected to said section.

The invention can be applied with particular advantage in the case of a halogen incandescent lamp having an axially symmetrical lamp vessel and an incandescent filament arranged therein in the shape of a U or V and of which the U-limb or V-limb respectively has at least one luminous filament section. Provided for each U-limb or V-limb of the incandescent filament is a transparent cylindrical sleeve which is equipped with an interference filter which reflects infrared rays, the luminous filament sections of the respective U-limb or V-limb being arranged axially in said sleeve. The above named transparent cylindrical sleeves retroflect the infrared radiation produced by the luminous filament sections onto the respective filament sections and thereby contribute to raising the light yield of the lamp, as already explained above.

III. DESCRIPTION OF THE PREFERRED EXEMPLARY EMBODIMENTS

Figure 2:
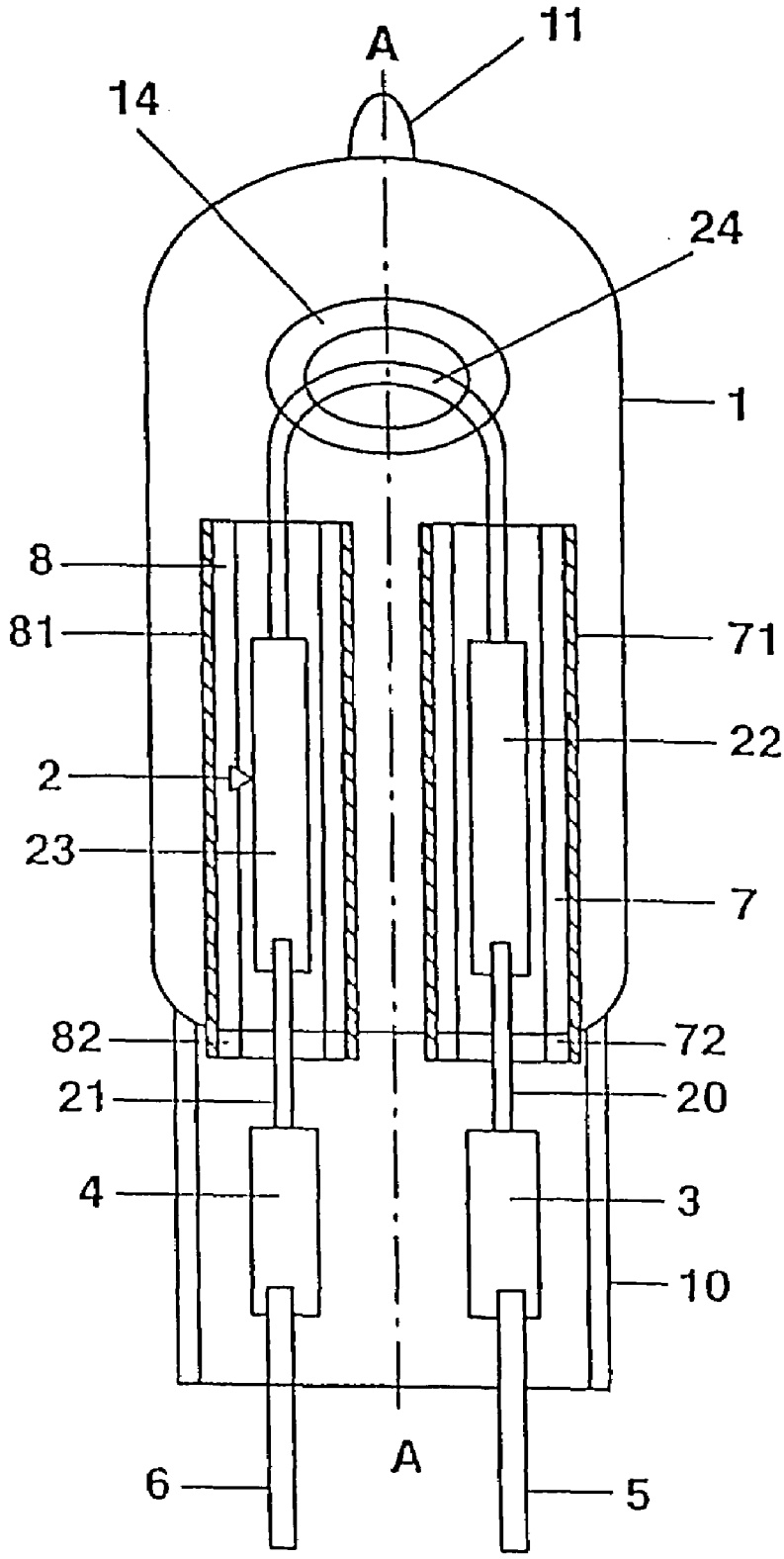
Figure 3:
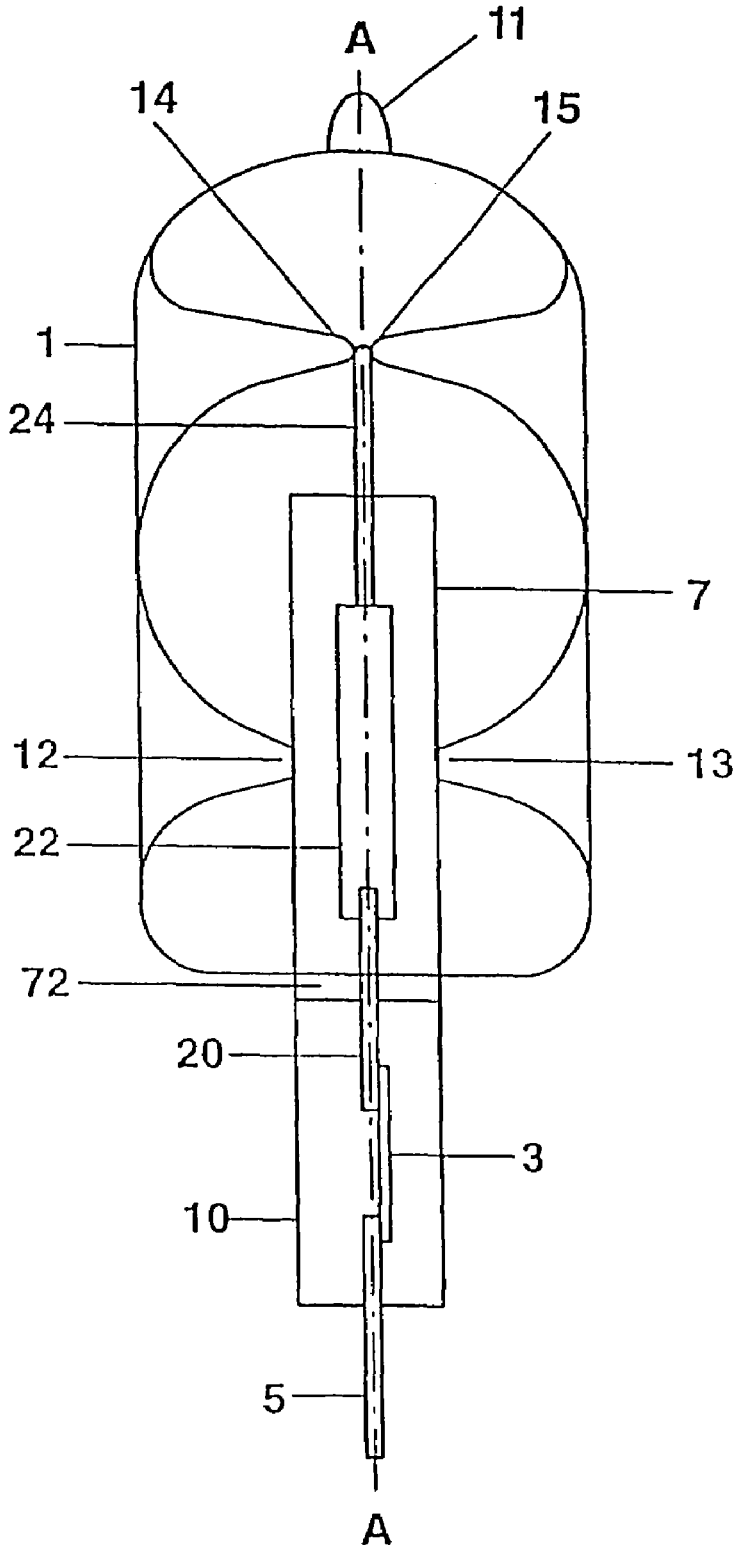
Figure 4:
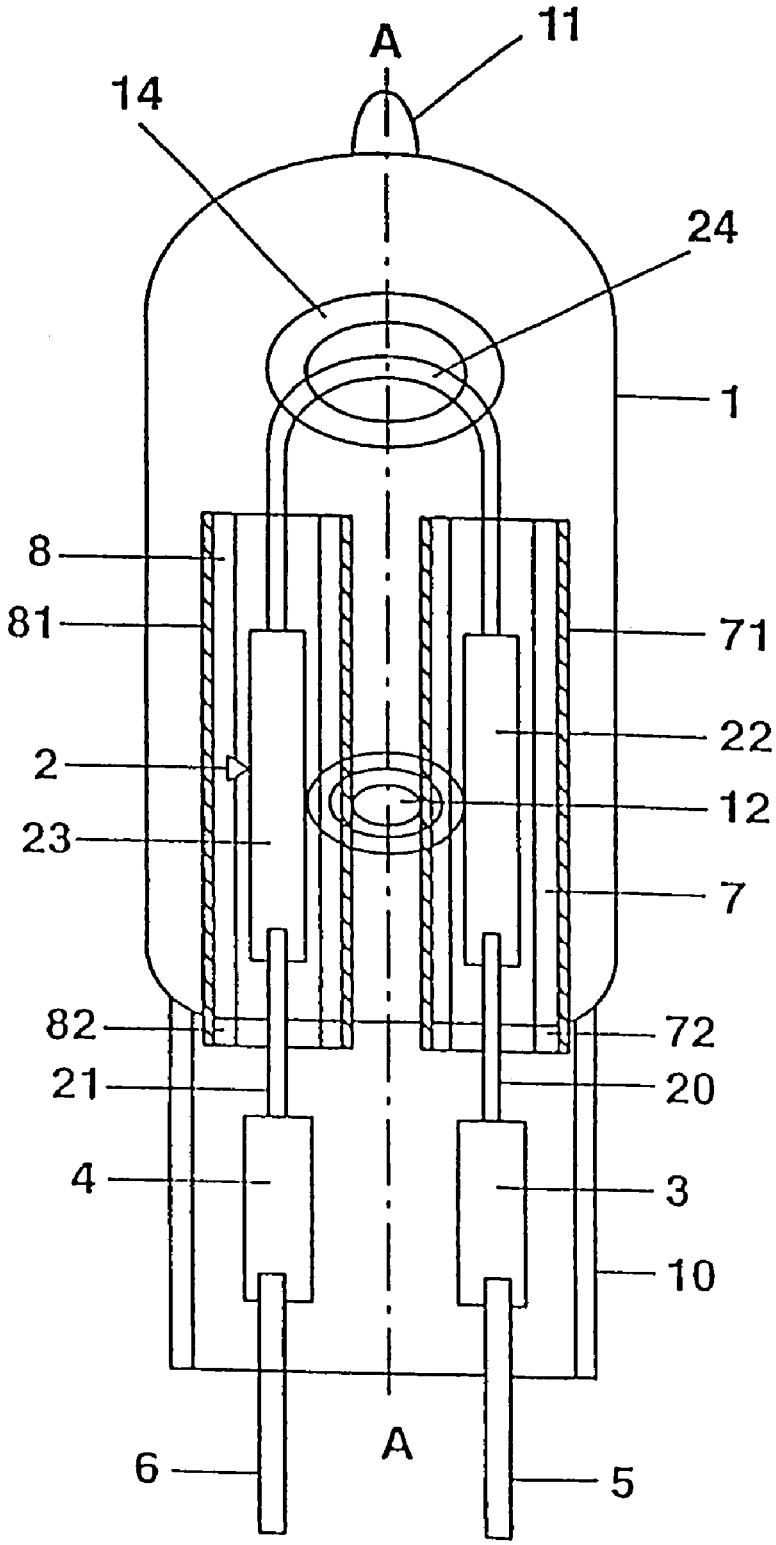

The invention is explained in more detail below with the aid of a number of preferred exemplary embodiments. In the drawing:

FIG. 1 shows a schematic of a side view in accordance with the first exemplary embodiment of the invention, FIG. 2 shows the exemplary embodiment of the invention depicted in FIG. 1, in a schematic of a side view rotated by 90 degrees by comparison to FIG. 1, FIG. 3 shows a schematic of a side view in accordance with the second exemplary embodiment of the invention, and FIG. 4 shows the exemplary embodiment of the invention depicted in FIG. 3, in a schematic of a side view rotated by 90 degrees by comparison to FIG. 3, All the exemplary embodiments of the invention are high-voltage halogen incandescent lamps that are provided for operation on AC supply voltage in a direct fashion, that is to say without connecting a voltage transformer in series. The first exemplary embodiment is illustrated schematically in FIGS. 1 and 2. This lamp has a lamp vessel 1 that consists of silica glass or hard glass and is formed in an axially symmetrical fashion with reference to its longitudinal axis A-A. The lamp vessel 1 is sealed at one end by means of a pinch seal 10. A sealed exhaust stub 11 is located at the opposite end of the lamp vessel 1. A U-shaped incandescent filament 2 is arranged inside the lamp vessel 1. The two ends 20, 21 of the incandescent filament 2 are respectively connected to a molybdenum foil 3, 4 and are sealed in the pinch seal 10 in a gastight fashion. Projecting from the pinch seal 10 are two supply lead wires 5, 6 that are respectively connected in an electrically conducting fashion to a molybdenum foil 3, 4.

Two U-limbs of the incandescent filament 2 respectively have a filament section 22, 23 that is luminous during operation of the lamp. These two filament sections 22, 23 are connected to one another by a bent, non-luminous section 24 of the incandescent filament 2. Arranged inside the lamp vessel 1 are two circularly cylindrical silica glass tubes 7, 8 that bear on the outer lateral surface an interference filter 71, 81 that reflects infrared rays, and respectively enclose the luminous filament section 22, 23 of a U-limb of the incandescent filament 2 without touching it. The filament sections 22, 23 are arranged axially in the silica glass tubes 7, 8 and run approximately parallel to the lamp vessel axis A-A. The inside diameter of the silica glass tubes 7, 8 is selected to be of sufficient size so that they do not impair the halogen cycle. The outside diameter of the silica glass tubes 7, 8 is smaller than the inside radius of the rotationally symmetrical part of the lamp vessel 1. The ends of the silica glass tubes 7 and 8, respectively, are fastened in each case to non-luminous sections 20, 21, 24 of the incandescent filament 2 by means of a pinch 72, 73 and 82, 83, respectively. The abovenamed pinches are not formed in a gastight fashion, in order to enable an exchange of gas with the interior of the lamp vessel, and not to impair the halogen cycle. The silica glass tubes 7, 8 are respectively sealed at one end 72, 82 in the pinch seal 10 of the lamp vessel 1 for the purpose of further mechanical stabilization. The incandescent filament 2 is held with the aid of two diametrically arranged, funnel like depressions 14, 15 in the wall of the lamp vessel 1 that are formed from the material of the lamp vessel 1. For this purpose, the non-luminous section 24 of the incandescent filament is arranged between the two depressions 14, 15 and fixed in this region on the wall of the lamp vessel 1 by a fused connection. This technique of holding an incandescent filament is described, for example, in laid-open specification EP 0 446 460 A2.

The second exemplary embodiment, illustrated schematically in FIGS. 3 and 4, differs from the first exemplary embodiment described in more detail above only by the silica glass tubes 7', 8', which are fixed in the lamp vessel 1 in a way differing from the silica glass tubes 7, 8 in accordance with the first exemplary embodiment. The two exemplary embodiments correspond in all other details. Consequently, the same reference numerals were used for identical parts in the figures of the two exemplary embodiments.

In accordance with the second exemplary embodiment of the invention, the silica glass tubes 7', 8' provided with interference filters 71', 81' bear against the inner wall of the lamp vessel 1 and are respectively sealed with one end 72', 82' in the pinch seal 10 of the lamp vessel 1. In addition, the two silica glass tubes 7', 8' are fixed on the lamp vessel 1 with the aid of two diametrically arranged, funnel-shaped depressions 12, 13 in the wall of the lamp vessel 1 that extend into the interior of the lamp vessel 1. The funnel-like depressions 12, 13 in the wall of the lamp vessel 1 sealed in a gastight fashion reach like a wedge into the interspaces between the two silica glass tubes 7, 8. Before the production of the pinch seal 10, the silica glass tubes 7', 8' are fixed on the lamp vessel 1 by means of the funnel-like depressions 12, 13 formed from the material of the lamp vessel 1. The silica glass tubes 7', 8' form a fused connection with the wall of the lamp vessel 1 in the region of the depressions 12, 13.

The invention is not restricted to the exemplary embodiments explained in more detail above. However, those ends of the silica glass tubes that are pinched over the non-luminous sections of the incandescent filament can also be sealed in a gastight fashion, and a halogen filling can be arranged in the interior of the silica glass tubes while no gas filling, or only a gas filling without a halogen additive, is arranged in the interior of the lamp vessel. The interference filters 71, 81 are thereby protected against chemical attacks of the halogen additive. However, the invention can also be applied to conventional halogen lamps without halogen additives.

Furthermore, each U-limb or V-limb of the incandescent filament can have a number of luminous filament sections that are connected to one another by non-luminous sections of the incandescent filament 2, and are likewise aligned axially in the silica glass tube. The non-luminous sections of the incandescent filament can, furthermore, be equipped with spacers for centering the luminous filament sections in the silica glass tubes. Suitable as a spacer is, for example, a spiral coil of tungsten whose diameter is coordinated with the inside diameter of the silica glass tubes, and which is fastened on the non-luminous section of the incandescent filament, or on the inwardly directed knobs in the wall of the silica glass tubes. However, the silica glass tubes can also be fixed in the lamp vessel with the aid of a metal frame.

Moreover, the present invention can also be applied to incandescent lamps that have an incandescent filament aligned transverse to the axis of symmetry or the longitudinal axis of the lamp vessel. In this case, the incandescent filament is, for example, enclosed by a silica glass tube that bears on its outer lateral surface an interference filter that reflects infrared rays. The ends of this silica glass tube are fastened, for example, on the supply lead wires of the incandescent filament or on a separate metal frame. A further fastening option for the silica glass tube consists in fastening the silica glass tube on the incandescent filament by means of spiral spacers whose diameter is adapted to the inside diameter of the silica glass tube, and which are fixed on the incandescent filament. Furthermore, it is also possible to use hard glass tubes, for example borosilicate glass tubes, instead of silica glass tubes.

The invention claimed is:

1. An electric incandescent lamp comprising:

a substantially axially symmetrical lamp vessel, at least one incandescent filament arranged in the lamp vessel having at least one filament section arranged outside the lamp vessel axis, supply leads for the at least one incandescent filament, an interference filter which reflects infrared rays, the at least one filament section is arranged axially in a transparent cylindrical sleeve which is provided with the interference filter, and wherein one end of said sleeve is at least one of disposed in a sealed end of the lamp vessel and the sleeve is fixed on the incandescent filament.

2. The electric incandescent lamp as claimed in claim 1, wherein the sleeve takes the form of a circularly cylindrical tube.

3. The electric incandescent lamp as claimed in claim 2, wherein the interference filter takes the form of a coating on the sleeve which reflects infrared rays.

4. The electric incandescent lamp as claimed in claim 2, wherein the sleeve is made of silica glass.

5. The electric incandescent lamp as claimed in claim 1, wherein the interference filter takes the form of a coating on the sleeve which reflects infrared rays.

6. The electric incandescent lamp as claimed in claim 1, wherein the sleeve is made of silica glass.

7. The electric incandescent lamp as claimed in claim 1, wherein the sleeve is fixed on the lamp vessel.

8. The electric incandescent lamp as claimed in claim 7, wherein the sleeve is fused with the lamp vessel by inwardly directed knobs thatare arranged on the wall of the lamp vessel.

9. The electric incandescent lamp as claimed in claim 1, wherein the sleeve is fixed on at least one non-luminous section of the incandescent filament by means of at least one pinch.

10. The electric incandescent lamp as claimed in claim 1, wherein said incandescent filament is substantially in the form of a U or V, and each U-limb or Vlimb of said incandescent filament has at least one filament section that is arranged axially in a transparent cylindrical sleeve that is provided with an interference filter which reflects infrared rays.

* * * * *